United States Patent [19]

Nauman

[11] 4,296,659

[45] Oct. 27, 1981

[54] JACK-O-LANTERN FORMING METHOD

[76] Inventor: Christopher A. Nauman, 160-A Willowdale Dr., #103, Frederick, Md. 21701

[21] Appl. No.: 77,554

[22] Filed: Sep. 21, 1979

[51] Int. Cl.[3] ..... B26D 3/00; B26F 1/46

[52] U.S. Cl. ..... 83/54; 83/55; 83/652; 30/130; 30/315; 30/316; 30/358

[58] Field of Search ..... 83/50, 54, 55, 652–657; 30/130, 315, 316, 358

[56] References Cited

U.S. PATENT DOCUMENTS

| | | | |
|---|---|---|---|
| 831,791 | 9/1906 | Lima | 83/653 |
| 1,211,556 | 1/1917 | Dore | 30/316 |
| 1,414,098 | 4/1922 | Santana | 30/315 |
| 1,520,856 | 12/1924 | Cosman | 30/316 |
| 3,004,340 | 10/1961 | Collins | 30/316 |
| 3,080,639 | 3/1963 | Maurizi | 83/50 |
| 3,965,574 | 5/1976 | Graves | 30/316 |
| 3,996,832 | 12/1976 | Schubert et al. | 83/54 |

FOREIGN PATENT DOCUMENTS

| | | | |
|---|---|---|---|
| 840057 | 7/1960 | United Kingdom | 30/316 |

*Primary Examiner*—James M. Meister
*Assistant Examiner*—K. Bradford Adolphson
*Attorney, Agent, or Firm*—Morton J. Rosenberg

[57] ABSTRACT

A Jack-O-Lantern forming method for cutting facial feature openings (14) in a pumpkin (12). At least one pumpkin die element (26) having a closed contour sidewall element (32) is provided. The sidewall element (32) has a lower edge (36) adapted for contiguous interface with the pumpkin outer surface contour (16). Additionally, the pumpkin die element (26) has an upper edge (38) adapted to be impact loaded for displacing the pumpkin die element (26) through a wall (22) of the pumpkin (12). The die element (26) is impacted on the upper edge (38) and displaced through the wall (22) to provide a plug element which is removable and is contoured in the form of one of the facial feature openings (14). Through use of a number of differently contoured die elements (26), a wide variety of facial feature contour openings (14) may be provided in a minimal time reference frame.

6 Claims, 9 Drawing Figures

JACK-O-LANTERN FORMING METHOD

BACKGROUND OF THE INVENTION

1. Field of the Invention

This invention pertains to the formation of a Jack-O-Lantern from a pumpkin. In particular, this invention relates to a plurality of pumpkin die elements of closed contour representing various facial features of a Jack-O-Lantern. More in particular, this invention relates to the use of a plurality of pumpkin die elements which are displaced through the wall of a pumpkin to provide facial feature openings through the pumpkin wall. Still further, this invention relates to pumpkin die elements having particular structural features directed to the impact loading of die elements through the pumpkin wall. Still further, this invention pertains to pumpkin die elements having an upper edge and a lower edge where the upper edge may include a flange section or rib element to increase the stress surface area when the die element is being impact loaded. More in particular, this invention pertains to a pumpkin die element which may have an arcuate lower edge surface to interface with the arcuate contour of the pumpkin outer surface. Still further, this invention pertains to a pumpkin die element which may include a lower edge formed into a knife edge for ease of displacement through the wall of a pumpkin. Additionally, this invention pertains to a method of forming a Jack-O-Lantern in a minimal time interval by providing closed contour die elements which are impact loaded and displaced through the wall of the pumpkin.

2. Prior Art

Systems for forming a Jack-O-Lantern from a pumpkin are known in the prior art. The closest prior art known to the inventor is U.S. Pat. No. 3,965,574, which is directed to a system for forming a Jack-O-Lantern. However, this system is extremely complex in structural formation including both a frontal plate and a rear plate which are secured each to the other on the outside of the pumpkin through cords. The frontal plate has a number of cutting instruments mounted for placement of various facial features and cutting instruments are rotatively forced against the outside of the pumpkin to cut out sections to form appropriate apertures. Such a system does not allow for use of relatively inexperienced persons, such as children, in the formation of a Jack-O-Lantern. Additionally, placement and mounting is time consuming and does not allow for a minimization of the time in providing Jack-O-Lantern facial feature openings.

Other prior art known to the inventor includes U.S. Pat. Nos. 634,892; 2,612,123; 2,876,714; 1,520,856; D221,245; D216,325; 2,499,309; 2,620,755; D145,812; D101,584; and, 929,215. In general, such prior art systems are directed to cookie cutter implements, or chopping knives. Such prior art devices do not provide for arcuate lower sections or edges to interface with an arcuate contour, such as that seen on a pumpkin. Such prior art systems generally would provide for a planar lower edge to cut through dough or other pliable material compositions. In particular, such prior art systems would not be amenable to a curved lower edge section, since such would not allow a complete cutting through of the composition.

Additionally, such prior art systems are generally not directed to upper edges having increased surface areas to allow impact loading. Increased surface areas would not be amenable to the prior art systems, since the increased area within the contour of the cookie cutter elements would defeat the purpose of such cookie cutting systems. In such prior art devices, it is not the opening which is important, but the internal contour of the dough and such increased surface area provided by rolled over sections or flanges would deform the internal material.

SUMMARY OF THE INVENTION

A Jack-O-Lantern forming system for cutting facial feature openings in a pumpkin. The pumpkin includes an arcuate outer surface contour in at least two directions orthogonal each to the other. The system includes at least one pumpkin die element forming a closed contour in a first plane. The pumpkin die element defines a continuous sidewall element extending in a direction substantially normal to the first plane and forms a lower edge adapted for contiguous interface with the pumpkin outer surface contour. Additionally, an upper edge is defined and is adapted to be impact loaded for displacing the pumpkin die element through a wall of the pumpkin.

An object of the subject invention is to provide a method for forming a Jack-O-Lantern from a pumpkin.

Another object of the subject invention is to minimize the time interval in forming the facial feature openings of a Jack-O-Lantern.

A still further object of the subject invention is to allow inexperienced persons to easily form the facial feature openings of a Jack-O-Lantern.

More in particular, this invention is directed to the provision of a plurality of facial feature opening die elements which are impact loaded through a wall of a pumpkin.

Further, this invention relates to the provision of a plurality of differently contoured facial feature die elements formed in closed contour which allows the user a wide variety of facial features to be cut into a pumpkin.

Additionally, a still further object of the subject invention is to provide die elements which are structurally formed having an impact loading edge of greater surface area than the remaining sidewall portions of the die element.

Another object of the subject invention is to provide an arcuate lower edge adapted to contiguously interface with the arcuate contoured outer surface of a pumpkin.

Still another object of the present invention is to permit a user to form the facial features of a Jack-O-Lantern without the use of sharp instruments, such as knives.

DESCRIPTION OF THE PREFERRED EMBODIMENTS

Referring now to FIGS. 1–9, there is shown Jack-O-Lantern forming system 10 for cutting facial feature openings 14 in pumpkin 12. In overall concept, Jack-O-Lantern forming system 10 is utilized to minimize the time in forming a Jack-O-Lantern finished product, while simultaneously allowing a wide parametric variation of contours to be used as facial feature openings 14. Additionally, Jack-O-Lantern forming system 10 allows the usee, with a minimum of effort, to produce an aesthetically pleasing Jack-O-Lantern.

Due to the fact that knives have been used to form Jack-O-Lanterns from pumpkin 12, adults have been wary in allowing children to form their own Jack-O-Lanterns. In some cases, where children have used knives on curved surfaces such as those found in pumpkins 12, injuries have resulted. Utilization of Jack-O-Lantern forming system 10, as will hereinafter be described, allows either children and/or adults to form Jack-O-Lanterns from pumpkins 12 with generally equal facility and with a minimization of any possible injuries resulting from inexperience and/or ineptitude in the use of sharpened implements such as knives. Further, use of Jack-O-Lantern forming system 10 minimizes the overall time in forming one of many varieties of Jack-O-Lantern facial feature openings 14. In actual practice, use of Jack-O-Lantern forming system 10 has resulted in a completed Jack-O-Lantern within the range of 3.0–4.0 minutes from initiation of the method, as will hereinafter be described in following paragraphs.

Figure 1:
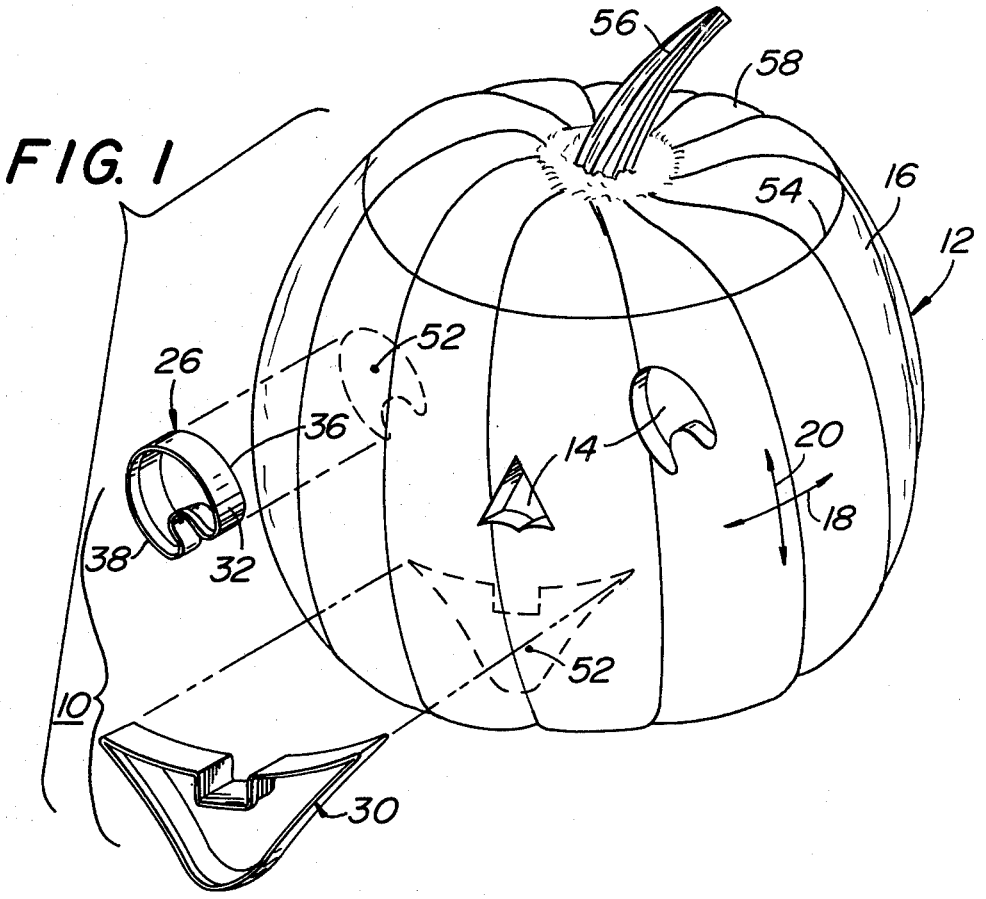
FIG. 1 is a perspective view partially exploded, showing a pumpkin and the Jack-O-Lantern forming system.

In general, Jack-O-Lantern forming system 10 is used in conjunction with pumpkin 12 having generally arcuate outer surface 16 in at least two orthogonal directions 18 and 20 each orthogonal to the other, as is shown by the directional arrows 18 and 20 as provided in FIG. 1. It is to be understood that pumpkins 12, as is herein provided, generally have arcuate outer surfaces 16, however, such pumpkin outer contours are not for the most part symmetrical in either directions 18 or 20. Pumpkin 12 includes peripheral wall 22, and internal pulp matter 24, as is clearly shown in FIGS. 2 and 3.

Figure 4:
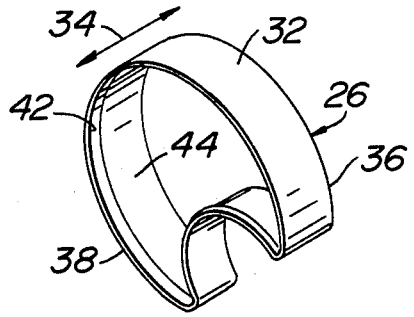
FIG. 4 is a perspective view of an eye die element shown in FIG. 1.

Jack-O-Lantern forming system 10 includes at least one pumpkin die element 26, as is shown in FIGS. 1 and 4. Assorted differently contoured die elements may be included, such as nose die element 28, shown in FIG. 7, and differently contoured mouth elements 30, 30' and 30'', shown in FIGS. 1, 6 and 8, respectively. The particular contours as is shown in the Figures is not important to the inventive concept, with the exception of the structural details applicable to all of die elements 26, 28, and 30, as will be described in following paragraphs.

Referring to pumpkin die element 26 being utilized as an example for differently contoured die elements such as those shown by elements 28, 30, 30', and 30'', reference is made now to FIGS. 1–4. Pumpkin die element 26 is seen to form a closed contour in a first plane. The first plane, as herein defined, will be generally parallel to a plane defined by the directional arcuate arrows 18 and 20 when pumpkin or eye die element 26 is adjacently mounted on arcuate outer surface 16 of pumpkin 12. Die element 26 includes continuous sidewall element 32 extending through a predetermined length in direction 34, generally normal to the previously referenced first plane. As is clearly seen in the Figures, the closed contour die elements such as element 26 define a through opening extending in direction 34.

Die element 26 thus forms lower edge 36 adapted for contiguous interface with pumpkin arcuate outer surface 16. Additionally, element 26 includes upper edge 38 which is in itself adapted to be impact loaded for displacing pumpkin die element 26 through pumpkin wall 22 of pumpkin 12.

Due to the fact that die element 26 may be stressed severely when impact loaded in sidewall length direction 34, an increased surface upper edge area 40 is provided for lowering load stresses when pumpkin die element 26 is impact loaded. As is seen clearly in FIGS. 3 and 4, upper edge 38 may include roll over portion 42 of sidewall element 32. Roll over portion 42 extends around inner surface 44 of sidewall element 32. In this manner, sidewall element 32 has essentially a double thickness in the region of upper edge 38 than the remaining extended direction of sidewall element 32 in direction 34.

Figure 8:
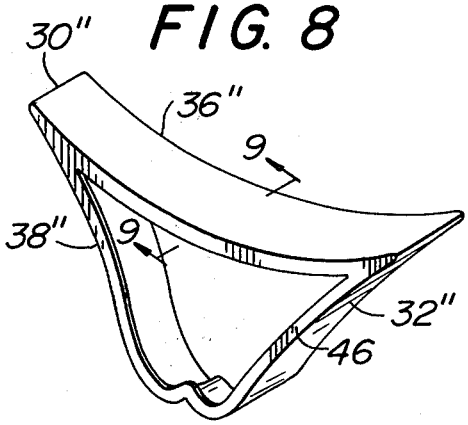
FIG. 8 is a contour embodiment of the mouth die element shown in FIG. 1.
Figure 9:
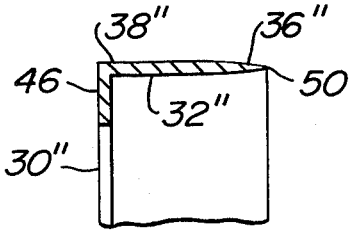
FIG. 9 is a sectional view of the embodiment shown in FIG. 8, taken along the section line 9—9.

The important concept, as is herein described, is to provide a larger surface area for impact loading stress criteria. In the embodiment shown in FIGS. 8 and 9, upper edge 38'' includes flange element 46 fixedly secured to upper edge 38'' and extending internal to the closed contour provided by sidewall element 32''. As can be seen in FIGS. 8 and 9, flange element 46 is generally formed in one-piece formation with sidewall elements 32''. Additionally, flange element 46 extends substantially in a direction normal or perpendicular to the extension length of sidewall element 32''. In this manner, flange element 46 provides for an increased impact loading area for mouth die element 30''.

Whether a roll over portion section 42 or flange element 46 is utilized, it is to be understood that such must extend internal to the overall closed contour of sidewall element 32 or 32'' in order that ragged edges are not provided in facial feature openings 14 subsequent to the displacement of die elements 28, 30', and/or 30'' through pumpkin wall section 22.

Figure 2:
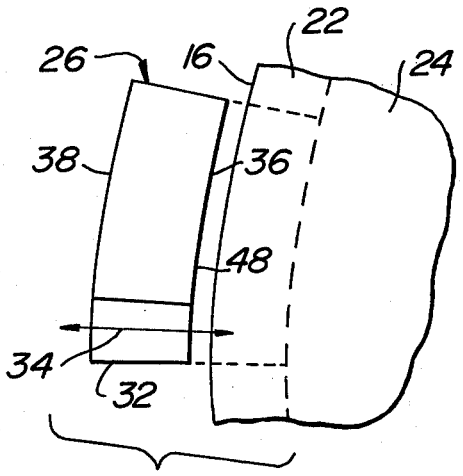
FIG. 2 is a sectional view of a pumpkin die element being placed adjacent the wall of a pumpkin.
Figure 3:
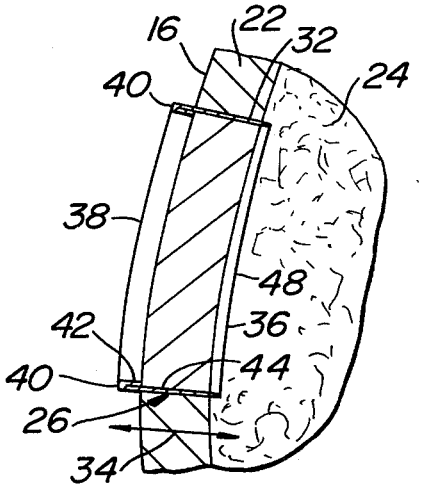
FIG. 3 is a sectional view of a pumpkin die element being inserted through the wall of a pumpkin.

One of the problems in forming a finished Jack-O-Lantern from pumpkin 12 is that lower edges 36, 36', and/or 36'' of respective die elements 30, 30', and 30'', are surfaces lying in a linear plane when trying to cut into an arcuate outer surface 16 defined by the directional arcuate lines 18 and 20. In order to obviate this problem, lower edge 36 may be arcuately contoured surface 48, as is seen in FIGS. 2 and 3. Arcuate surface 48 is curved in a second plane, substantially normal to aforementioned first plane for providing substantially contiguous interface of lower edge 36 with pumpkin arcuate outer surface 16. Thus, lower edge arcuate contour surface 48 may be a segment of a circle having a predetermined radius of curvature. The radius of curvature is not important to the inventive concept as is herein described, with the exception that upon positioning of die element 26 (being used for example purposes only) in contiguous interface with arcuate outer surface 16 of pumpkin 12, that there would be at least two points in contact with outer surface 16 to prevent sliding of die element 26 subsequent to a first initial impact loading. Radii of curvature which have successfully been used may range between 4.0–8.0 inches.

In the embodiment shown in FIGS. 8 and 9, mouth die element 30'' is further provided with knife edge 50 formed on lower edge 36''. Thus, lower edge 36'' is formed to provide a lower surface area than a wall thickness of sidewall element 32'' in order to increase the stress load on pumpkin wall 22 when pumpkin die element 30'' is impact loaded. It is obvious that the embodiment shown in FIGS. 8 and 9 relating to both flange element 46, as well as knife edge 50, may be incorporated in one or more of die elements 26, 28, 30, 30', and/or 30''.

Sidewall elements, represented by sidewall 36, of eye die element 26 must include an extended direction dimension in direction 34 which is greater than the thickness of pumpkin wall 22. Obviously, die element 26 must be impact loaded through wall 22 and internal to pumpkin 12 within pulp 24. Thus, the extended length of die element 26 would have to be greater than thicknesses of wall 22 and through experimentation, it has been found that wall thicknesses for pumpkins 12 generally approximate 0.75 inches. Thus, the extended direction of sidewall element 32 in direction 34 has been used successfully in the range of 0.5–1.0 inches with die elements 26, 28, 30, 30', and 30'', being formed of a steel composition in order to provide structural integrity during the impact loading phase of the forming of the Jack-O-Lantern. Additionally, sidewall elements represented by element 32 have been found to be successfully used when a thickness within the approximate range of 0.02–0.1 inches is utilized.

Figure 5:
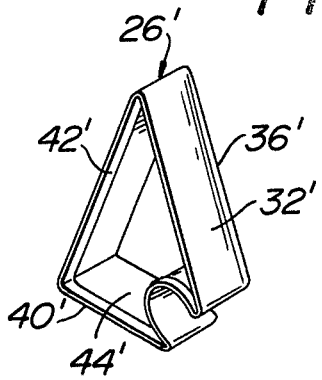
FIG. 5 is a perspective view of a triangularly contoured die element.

Referring now to FIG. 5, there is seen an eye die element 26' having a generally triangularly shaped closed contour. In this embodiment, it is seen that lower edge 36' is generally planar in contour and does not include the lower edge arcuate contour surface 48 as is in evidence in FIGS. 2 and 3 when directed to pumpkin die element 26. Eye die element 26' further includes roll over portion 42' formed on inner surface 44' of sidewall element 32'. As was the case in die element 26, die element 26' presents an increased upper edge surface 40' due to the roll over portion 42'.

Figure 6:
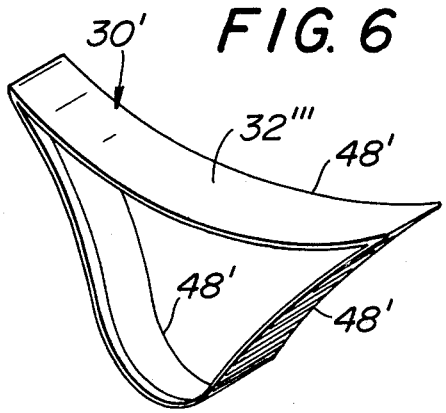
FIG. 6 is a perspective view of a mouth die element embodiment showing an arcuate contour.
Figure 7:
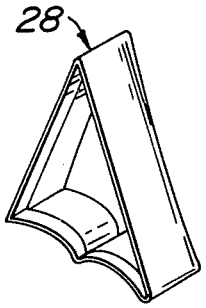
FIG. 7 is a triangularly shaped nose die element, representing the die element which would form the nose feature shown in FIG. 1.

As shown in FIG. 6, mouth die element 30' includes closed contour sidewall element 32'''. Additionally, this embodiment shows generally lower edge arcuate contour surfaces 48' for contiguous interface with arcuate pumpkin surface 16. FIG. 7 is directed to nose die element 28 forming the nose facial feature opening shown in FIG. 1.

In accordance with Jack-O-Lantern forming system 10, there is further provided a method of forming a Jack-O-Lantern from pumpkin 12 which includes the initial step of providing at least one closed contour pumpkin die element 26 defining continuous sidewall element 32, having both upper edge 38 and lower edge 36, as is seen in FIG. 1. Marking 52 provides a positional location point for closed contour pumpkin die element 26 and/or 30 on outer surface of pumpkin 12. Marking 52 may be made through a ballpoint pen, or a felt-tip pen, and merely designates a positional placement for various facial openings 14 desired by the user.

Pumpkin die elements, as represented by die element 26, are positioned adjacent and contiguous outer surface 16 of pumpkin 12, at a predetermined location designated by point markings 52. In general, die element 26 is mounted in a manner such that point markings 52 are substantially centrally located within the closed contour of die element 26.

Upper edge 38 of die element 26 may be covered by a planar member represented by a block of wood, and upper edge 38 is impact loaded through use of an impact device such as a hammer. Die element 26 is displaced through wall 22 of pumpkin 12. Die element 26 is impact loaded until element 26 is displaced internal to pumpkin 12. Once die element 26 has passed through wall section 22 of pumpkin 12, and generally along topping line 54 shown in FIG. 1, in order to provide access internal to pumpkin 12. Pumpkin 12 is grasped by stem 56, and the top portion 58 is removed. Finally, die element 26 and pulp is removed from internal pumpkin 12 and a completed Jack-O-Lantern is evidenced.

Although this invention has been described in connection with specific forms and embodiments thereof, it will be appreciated that various modifications other than those discussed above may be resorted to without departing from the spirit or scope of the invention. For example, equivalent elements may be substituted for those specifically shown and described, certain features may be used independently of other features, and in certain cases, particular locations of elements may be reversed or interposed, all without departing from the spirit or the scope of the invention as defined in the appended Claims.

What is claimed is:

1. A method of forming a Jack-O-Lantern from a pumpkin including the steps of:

(a) providing a closed contour pumpkin die element defining a continuous sidewall element forming a through opening, said pumpkin die element having an upper edge and a lower edge;

(b) positioning said pumpkin die element adjacent an outer surface of said pumpkin at a predetermined location;

(c) striking said upper edge of said pumpkin die element; and, (d) displacing said pumpkin die element entirely through a wall of said pumpkin to a position internal said pumpkin.

2. The method of forming a Jack-O-Lantern as recited in claim 1 where the step of displacing said pumpkin die element is followed by the step of removing a wall section of said pumpkin internal said closed contour.

3. The method of forming a Jack-O-Lantern as recited in claim 1 where the step of positioning said pumpkin die element includes the step locating said die element in a region adapted to a formation of facial features.

4. The method of forming a Jack-O-Lantern as recited in claim 1 where the step of positioning said pumpkin die element is preceded by the step of marking a positional location point for said closed contour pumpkin die element on an outer surface of said pumpkin.

5. The method of forming a Jack-O-Lantern as recited in claim 1 where the step of displacing said pumpkin die element is followed by the step of topping said pumpkin to provide access internal said pumpkin.

6. The method of forming a Jack-O-Lantern as recited in claim 5, where the step of topping is followed by the step of removing said die element and pulp from internal said pumpkin.

* * * * *